US010935312B2

(12) United States Patent
Ott et al.

(10) Patent No.: US 10,935,312 B2
(45) Date of Patent: Mar. 2, 2021

(54) BALANCING POWER IN SPLIT MIXED REFRIGERANT LIQUEFACTION SYSTEM

(71) Applicant: Air Products and Chemicals, Inc., Allentown, PA (US)

(72) Inventors: Christopher Michael Ott, Macungie, PA (US); Jonathan James Berg, Allentown, PA (US); Annemarie Ott Weist, Macungie, PA (US); Joseph Gerard Wehrman, Macungie, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 24 days.

(21) Appl. No.: 16/053,196

(22) Filed: Aug. 2, 2018

(65) Prior Publication Data

US 2020/0041203 A1 Feb. 6, 2020

(51) Int. Cl.
*F25J 1/02* (2006.01)
*F25J 1/00* (2006.01)

(52) U.S. Cl.
CPC ..... *F25J 1/0298* (2013.01); *F25J 1/0022* (2013.01); *F25J 1/0214* (2013.01); *F25J 1/0216* (2013.01); *F25J 1/0283* (2013.01); *F25J 2280/50* (2013.01)

(58) Field of Classification Search
CPC ..... F25J 1/0022; F25J 1/029; F25J 1/0295; F25J 1/0289; F25J 1/0298; F25J 2280/50
See application file for complete search history.

(56) References Cited

U.S. PATENT DOCUMENTS

| | | | |
|---|---|---|---|
| 3,763,658 A | 10/1973 | Gaumer et al. | |
| 5,791,160 A | 8/1998 | Mandler et al. | |
| 6,725,688 B2 | 4/2004 | Elion et al. | |
| 6,789,394 B2 | 9/2004 | Elion et al. | |
| 2008/0056910 A1* | 3/2008 | Wolflick | F04D 25/04 417/1 |

(Continued)

FOREIGN PATENT DOCUMENTS

| | | |
|---|---|---|
| DE | 102004023814 | 12/2005 |
| WO | 2008139528 | 11/2008 |
| WO | 2017211871 | 12/2017 |

OTHER PUBLICATIONS

Pillarella, et al. "The C3MR Liquefaction Cycle: Versatility for a Fast Growing, Ever Changing LNG Industry". PS2-5, Jan. 2007, pp. 1-14.

(Continued)

*Primary Examiner* — Brian M King
(74) *Attorney, Agent, or Firm* — Amry Carr-Trexler

(57) ABSTRACT

A split mixed refrigerant ("MR") natural gas liquefication system, where low-pressure ("LP") and medium pressure ("MP") MR compressors are driven by a first gas turbine and a propane compressor and a high-pressure ("HP") MR compressor is driven by a second gas turbine, is disclosed. The split MR liquefication system is configured to adjust the characteristics of the HP MR compressor to require less power when less power is available and more power when more power is available compared to the system's design point. Such adjustments allow for shifting the balance of power between the propane compressor and the HP MR compressor to improve LNG production efficiency.

33 Claims, 6 Drawing Sheets

(56) References Cited

U.S. PATENT DOCUMENTS

| | | | | |
|---|---|---|---|---|
| 2011/0135498 | A1* | 6/2011 | Gibson | B60W 10/06 417/15 |
| 2012/0067080 | A1* | 3/2012 | Byfield | F25B 5/04 62/613 |
| 2014/0311183 | A1 | 10/2014 | Van Aken | |
| 2017/0089637 | A1* | 3/2017 | Wehrman | F04B 41/06 |
| 2017/0336136 | A1* | 11/2017 | Brostow | F25J 1/0292 |
| 2019/0249921 | A1* | 8/2019 | Bongermino | F25J 1/0052 |

OTHER PUBLICATIONS

Yoshitsugi Kikkawa, et al, "Optimize the Power System of Baseload LNG Plant", Proceedings Gas Processors Association, GPA Meeting/Annual Convention, Mar. 14, 2001, pp. 1-23.

Allen E. Brimm, et al, "Operating Experience With the Split MR Machinery Configuration of the C3MR LNG Process", SPE Projects, Facilities and Construction, vol. 1, No. 02, Jun. 1, 2006, pp. 1-5.

Christopher M. Ott, et al, "Large LNG Trains: Technology Advances to Address Market Challenges", Gastech 2015 Singapore, Oct. 28, 2015.

Olve Skjeggedal, et al, "Optimising and Scaling Up the Brayton Nitrogen Refrigeration Cycle for Offshore and Onshore LNG Applications", Gastech 2009, The 24th International Conference and Exhibition for the LNG, LPG and Natural Gas Industries, May 25-28, 2009, Abu Dhabi, May 25, 2009.

* cited by examiner

BALANCING POWER IN SPLIT MIXED REFRIGERANT LIQUEFACTION SYSTEM

BACKGROUND

A number of liquefaction systems for cooling, liquefying, and optionally sub-cooling natural gas are well known in the art, such as the single mixed refrigerant ("SMR") cycle, the propane pre-cooled mixed refrigerant ("C3MR") cycle, the dual mixed refrigerant ("DMR") cycle, C3MR-Nitrogen hybrid (such as AP-X™) cycles, the nitrogen or methane expander cycle, and cascade cycles. Typically, in such systems, natural gas is cooled, liquefied, and optionally sub-cooled by indirect heat exchange with one or more refrigerants. A variety of refrigerants might be employed, such as mixed refrigerants, pure components, two-phase refrigerants, gas phase refrigerants, etc. Mixed refrigerants ("MR"), which are a mixture of nitrogen, methane, ethane/ethylene, propane, butanes, and pentanes, have been used in many base-load liquefied natural gas ("LNG") plants. The composition of the MR stream is typically optimized based on the feed gas composition and operating conditions.

The refrigerant is circulated in a refrigerant circuit that includes one or more heat exchangers and one or more refrigerant compression systems. The refrigerant circuit may be closed-loop or open-loop. Natural gas is cooled, liquefied, and/or sub-cooled by indirect heat exchange against the refrigerants in the heat exchangers.

U.S. Pat. No. 3,763,658 to Gaumer et al teaches a C3MR natural gas liquefaction process utilizing two refrigerant systems: propane for precooling natural gas, and a mixed refrigerant system for liquefying and subcooling the natural gas. In this process, the propane compressor is of a size that allows for all multistage compression to be done in one casing. By contrast, the MR compression is more extensive and typically requires two to three casings. As a result, the MR compressor requires approximately twice the amount of power that the propane compressor requires.

Some users prefer using identical turbine drivers on both compression systems. If the compression systems are arranged such that the propane compressor is on one driver and all the MR compression is on the other, there would be unused power potential on the propane driver, because the MR compression requires approximately twice the power of the propane compression. This imbalance in mechanical loads between the two systems when using identical drivers leads to power potential being wasted. To counter this, some C3MR natural gas liquefaction processes utilize two gas turbines in a "split" arrangement, where low pressure ("LP") and medium pressure ("MP") MR compressors are driven by one gas turbine driver, and a propane compressor and high pressure ("HP") MR compressor are driven by the second driver. In other words, a portion of the power generated by the propane compressor driver is diverted or "split" to the MR compressor, which helps balance the loads on the systems and maximize LNG production. This arrangement is offered commercially by Air Products and Chemicals, Inc. as its SplitMR® driver/compressor arrangement.

One limitation of a split arrangement is that the relative power usage between the two drivers changes with ambient temperature. At the design ambient temperature, the process and compressor designs can be optimized to balance the compressor power such that the power from both drivers is fully utilized. But at ambient temperatures warmer than design, the propane compressor requires a higher percentage of the overall power, while the drivers have a lower power output. This results in the propane and HP MR compressor driver generally consuming the maximum available driver power in the warmer months. However, the LP and MP MR compressor driver is not able to fully use the available power. Thus, for SplitMR® configurations, production drops during these hotter months because there is less available power and not all available power can be fully utilized. Conversely, at ambient temperatures colder than design, the LP MR/MP MR compressor generally consumes the maximum driver power, leaving unused power on the propane/HP MR compressor string. In areas with large temperature ranges, such as those found in temperate, arctic, or US Gulf coast climates, the effect can be significant.

This problem is magnified when aero-derivative gas turbines are used. Generally, aero-derivative gas turbines have a larger power reduction at higher ambient temperature than industrial gas turbine drivers. In addition, when industrial gas turbines are used, a helper motor may also be used. Therefore, for aero-derivative gas turbine driver arrangements there is a larger percentage of power reduction at higher ambient temperature than when industrial gas turbine drivers are used in conjunction with helper motors.

Based on the foregoing, there is a need for a liquefaction system that can take full advantage of the benefits of split MR compression over a wide range of ambient temperatures.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

The disclosed exemplary embodiments provide, as described below and as defined by the claims which follow, a split mixed refrigerant ("MR") natural gas liquefication system, where low-pressure ("LP") and medium pressure ("MP") MR compressors are driven by a first driver (such as a gas turbine) and a propane compressor and a high-pressure ("HP") MR compressor are driven by a second driver. The split MR liquefication system is operationally configured to allow for adjustment of the characteristics of the HP MR compressor to require less power in warmer ambient temperatures and more power in cooler ambient temperatures compared to the system's design temperature. Such adjustments allow for shifting the balance of power between the propane compressor and the HP MR compressor to improve LNG production efficiency.

In addition, several specific aspects of the systems and methods of the present invention are outlined below.

Aspect 1: A method of operating a hydrocarbon fluid liquefaction system, the method comprising:

a. precooling a hydrocarbon feed stream by indirect heat exchange with a precooling refrigerant stream to produce a precooled hydrocarbon fluid stream having a temperature within a first predetermined range;

b. compressing the precooling refrigerant stream in a precooling compressor having at least one compression stage;

c. further cooling and at least partially liquefying the precooled hydrocarbon stream by indirect heat exchange against a second refrigerant stream to produce a cooled hydrocarbon fluid stream having a temperature within a second predetermined range;

d. compressing the second refrigerant stream in a compression sequence comprising a plurality of compression stages;

e. driving the precooling compressor and at least one second refrigerant compression stage of the plurality of second refrigerant compression stages with a first driver having a first maximum available power;

f. driving the other second refrigerant compression stages of the plurality of mixed refrigerant compression stages with a second driver having a second maximum available power; and g. operating the at least one second refrigerant compression stage at a first power requirement, which results in a first combined power utilized by the first and second drivers;

h. adjusting power requirement of the at least one second refrigerant compression stage to a second power requirement;

i. operating the at least one second refrigerant compression stage at the second power requirement, which results in a second combined power utilized by the first and second drivers, the second combined power being greater than the first combined power.

Aspect 2: The method of Aspect 1, wherein step (e) comprises driving the precooling compressor and at least one second refrigerant compression stage of the plurality of second refrigerant compression stages with the first driver having the first maximum available power, the at least one second refrigerant compression stage having a discharge pressure that is greater than any other compression stage of the plurality of second refrigerant compression stages.

Aspect 3: The method of any of Aspects 1-2, further comprising performing step (h) wherein an ambient temperature is outside a predetermined design ambient temperature.

Aspect 4: The method of any of Aspects 1-3, further comprising performing step (h) wherein an ambient temperature is above a predetermined design ambient temperature.

Aspect 5: The method of Aspect 4, wherein step (h) comprises decreasing the power requirement of the at least one second refrigerant compression stage.

Aspect 6: The method of any of Aspects 1-5, wherein step (g) comprises operating at least one second refrigerant compression stage at a first power requirement, which results in a first combined power utilized by the first and second drivers, one of the first and second drivers delivering maximum available power and another one of the first and second drivers not delivering maximum available power as result of compression demands of the at least one second refrigerant compression stage and the precooling compressor.

Aspect 7: The method of any of Aspects 1-6, wherein adjusting power requirement of the at least one second refrigerant compression stage to a second power requirement comprises adjusting the position of a suction throttle valve in fluid flow communication with a suction side of the at least one second refrigerant compression stage.

Aspect 8: The method of Aspect 7, wherein adjusting power requirement of the at least one second refrigerant compression stage to a second power requirement comprises changing the position of a set of adjustable inlet guide vanes located in the at least one second refrigerant compression stage.

Aspect 9: The method of any of Aspects 1-8, wherein adjusting power requirement of the at least one second refrigerant compression stage to a second power requirement comprises changing a gear ratio of a variable speed gearbox located between the precooling compressor and the at least one second refrigerant compression stage on a drive shaft of the first driver.

Aspect 10: The method of any of Aspects 1-9, wherein the second refrigerant comprises a mixed refrigerant.

Aspect 11: The method of any of Aspects 1-10, wherein the precooling refrigerant consists of propane.

Aspect 12: The method of any of Aspects 1-11, wherein the precooling refrigerant stream consists of a mixed refrigerant.

Aspect 13: A system comprising:

a precooling subsystem having a precooling compressor having at least one first refrigerant compression stage and at least one precooling heat exchanger, the precooling subsystem being adapted to cool a hydrocarbon feed stream by indirect heat exchange against a first refrigerant stream to produce a precooled hydrocarbon fluid stream;

a liquefaction subsystem having a plurality of second refrigerant compression stages and at least one liquefaction heat exchanger, the liquefaction system being adapted to at least partially liquefy the precooled hydrocarbon stream by indirect heat exchange against a second refrigerant stream to produce a cooled hydrocarbon fluid stream;

a first driver that drives the precooling compressor and at least one second refrigerant compression stage of the plurality of second refrigerant compression stages;

a second driver that drives the other second refrigerant compression stages of the plurality of second refrigerant compression stages;

means for changing a power requirement of the at least one second refrigerant compression stage; and a controller adapted to measure a first power state of the first driver and a second power state of the second driver and to control the power requirement of the at least one second refrigerant compression stage, the first power state of the first driver, the second power state of the second driver, and a flow rate of at least one selected from the group of the hydrocarbon feed stream and the precooled hydrocarbon stream.

Aspect 14: The system of Aspect 13, wherein the controller is programmed to reduce a difference between the first power state and the second power state by adjusting the means for changing a power requirement of the at least one second refrigerant compression stage.

Aspect 15: The system of any of Aspects 13-14, wherein the at least one second refrigerant compression stage has a discharge pressure that is greater than any other second refrigerant compression stages of the plurality of second refrigerant compression stages.

Aspect 16: The system of any of Aspects 13-15, wherein the means for changing a power requirement of the at least one second refrigerant compression stage comprises a suction throttle valve in fluid flow communication with a suction side of the at least one second refrigerant compression stage.

Aspect 17: The system of any of Aspects 13-16, wherein means for changing a power requirement of the at least one second refrigerant compression stage comprises a set of adjustable guide vanes in fluid flow communication with a suction side of the at least one second refrigerant compression stage.

Aspect 18: The system of any of Aspects 13-17, wherein means for changing a power requirement of the at least one second refrigerant compression stage comprises a variable speed gearbox located between the precooling compressor and the at least one second refrigerant compression stage on a drive shaft of the first driver.

Aspect 19: The system of any of Aspects 13-18, wherein in the first driver comprises at least two drivers arranged in parallel.

Aspect 20: The system of any of Aspects 13-19, wherein the second driver comprises at least two drivers arranged in parallel.

Aspect 21: The method of any of Aspects 13-20, wherein the second refrigerant stream comprises a mixed refrigerant.

Aspect 22: The method of any of Aspects 13-21, wherein the first refrigerant stream consists of propane.

Aspect 23: The method of any of Aspects 13-22, wherein the precooling refrigerant stream consists of a mixed refrigerant.

Aspect 24: A method of operating a hydrocarbon fluid liquefaction system, the method comprising:

a. precooling a hydrocarbon feed stream, being fed at a first flow rate, by indirect heat exchange with a precooling refrigerant stream and a precooled hydrocarbon fluid stream having a temperature within a first predetermined range;

b. compressing the precooling refrigerant stream in a precooling compressor having at least one compression stage;

c. further cooling and at least partially liquefying the precooled hydrocarbon stream by indirect heat exchange against a second refrigerant stream to produce a cooled hydrocarbon fluid stream having a temperature within a second predetermined range;

d. compressing the second refrigerant stream in a compression sequence comprising a plurality of second refrigerant compression stages, the plurality of second refrigerant compression stages consisting of a first set of second refrigerant compression stages and a second set of second refrigerant compression stages;

e. driving the precooling compressor and the first set of second refrigerant compression stages with a first driver;

f. driving the second set of second refrigerant compression stages with a second driver;

g. operating at least one of the first set of second refrigerant compression stages at a first power requirement that results in a first power differential between the first driver and second driver;

h. adjusting the compression power requirement of at least one of the first set of second refrigerant compression stages, which results in a second power differential between the first driver and the second driver, the second power differential being less than the first power differential; and i. increasing the first flow rate of the hydrocarbon feed stream to a second flow rate either concurrently or after performing step (h), while maintaining the temperature of the precooled hydrocarbon fluid stream within the first predetermined range and the temperature of the cooled hydrocarbon fluid stream within the second predetermined range.

Aspect 25: The method of Aspect 24, wherein step (e) comprises driving the precooling compressor and the first set of second refrigerant compression stages with a first driver, the first set of second refrigerant compression stages consisting of a stage having a discharge pressure that is greater than any of the second set of second refrigerant compression stages.

Aspect 26: The method of any of Aspects 24-25, further comprising performing step (h) wherein an ambient temperature is outside a predetermined design ambient temperature.

Aspect 27: The method of any of Aspects 24-26, further comprising performing step (h) wherein an ambient temperature is above a predetermined design ambient temperature.

Aspect 28: The method of Aspect 27, wherein step (h) comprises decreasing the power requirement of the at least one of the first set of second refrigerant compression stages.

Aspect 29: The method of any of Aspects 24-28, wherein adjusting the compression power requirement of at least one of the first set of second refrigerant compression stages comprises adjusting the position of a suction throttle valve in fluid flow communication with a suction side of the at least one of the first set of second refrigerant compression stages.

Aspect 30: The method of any of Aspects 24-29, wherein adjusting the compression power requirement of at least one of the first set of second refrigerant compression stages comprises changing the position of a set of adjustable inlet guide vanes located in the at least one of the first set of second refrigerant compression stages.

Aspect 31: The method of any of Aspects 24-30, wherein adjusting the compression power requirement of at least one of the first set of second refrigerant compression stages comprises changing a gear ratio of a variable speed gearbox located between the precooling compressor and the at least one of the first set of second refrigerant compression stages on a drive shaft of the first driver.

Aspect 32: The method of any of Aspects 24-31, wherein the second refrigerant stream comprises a mixed refrigerant.

Aspect 33: The method of any of Aspects 24-32, wherein the precooling refrigerant stream consists of propane.

Aspect 34: The method of any of Aspects 24-33, wherein the precooling refrigerant stream consists of a mixed refrigerant.

BRIEF DESCRIPTION OF DRAWINGS

For a more complete understanding of the claimed invention, reference is made to the following detailed description of an embodiment considered in conjunction with the accompanying drawings, in which:

DETAILED DESCRIPTION OF INVENTION

Figure 1:
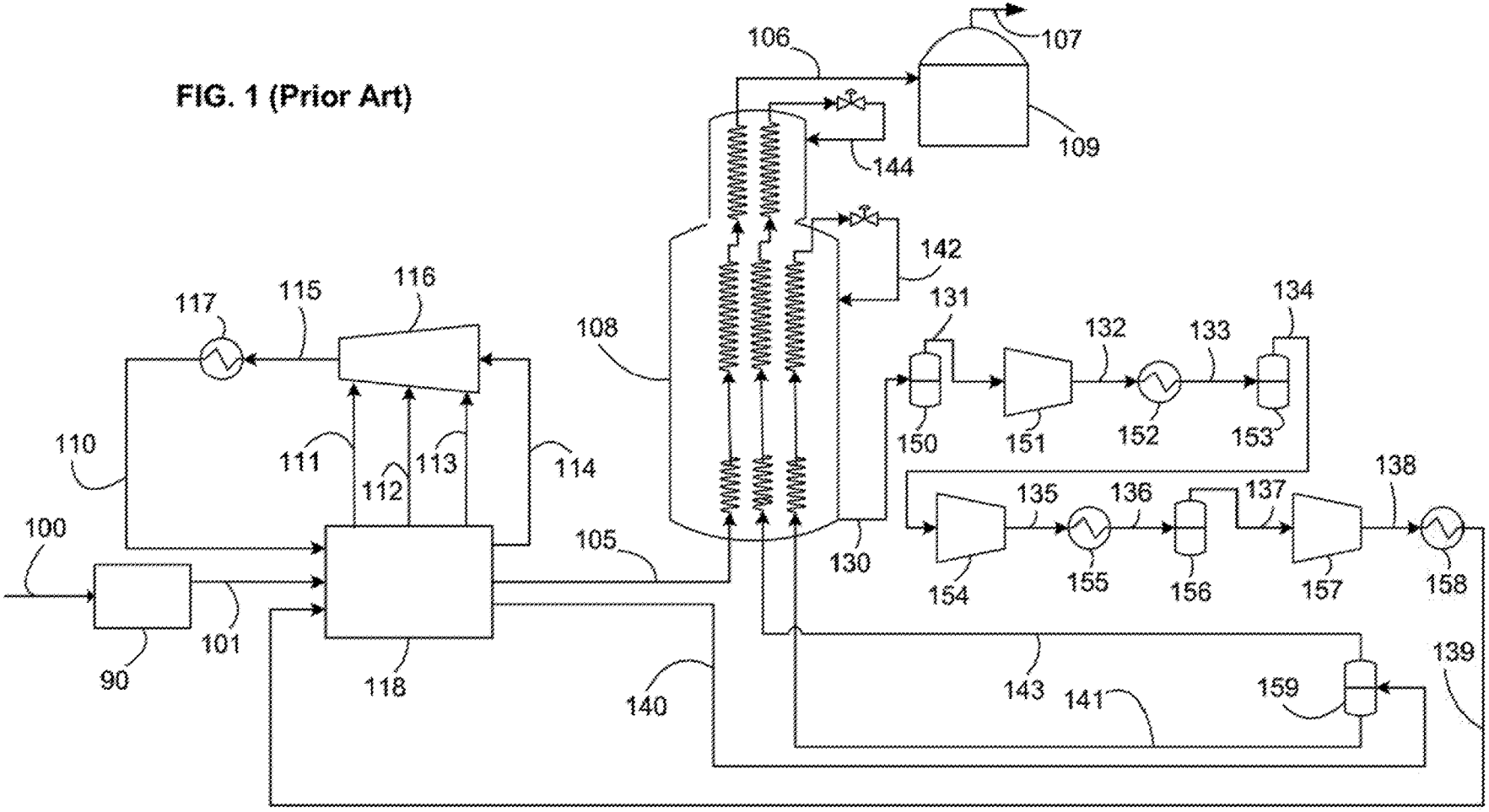
FIG. 1 (Prior Art)
FIG. 1 is a schematic flow diagram of a C3MR process in accordance with the prior art.

The ensuing detailed description provides preferred exemplary embodiments only, and is not intended to limit the scope, applicability, or configuration of the claimed invention. Rather, the ensuing detailed description of the preferred exemplary embodiments will provide those skilled in the art with an enabling description for implementing the preferred exemplary embodiments of the claimed invention. Various changes may be made in the function and arrangement of elements without departing from the spirit and scope of the claimed invention.

Reference numerals that are introduced in the specification in association with a drawing figure may be repeated in one or more subsequent figures without additional description in the specification in order to provide context for other features.

In the claims, letters are used to identify claimed steps (e.g. (a), (b), and (c)). These letters are used to aid in referring to the method steps and are not intended to indicate the order in which claimed steps are performed, unless and only to the extent that such order is specifically recited in the claims.

Directional terms may be used in the specification and claims to describe portions of the present invention (e.g., upper, lower, left, right, etc.). These directional terms are merely intended to assist in describing exemplary embodiments, and are not intended to limit the scope of the claimed invention. As used herein, the term "upstream" is intended to mean in a direction that is opposite the direction of flow of a fluid in a conduit from a point of reference. Similarly, the term "downstream" is intended to mean in a direction that is the same as the direction of flow of a fluid in a conduit from a point of reference.

Unless otherwise stated herein, any and all percentages identified in the specification, drawings and claims should be understood to be on a weight percentage basis. Unless otherwise stated herein, any and all pressures identified in the specification, drawings and claims should be understood to mean gauge pressure.

The term "fluid flow communication," as used in the specification and claims, refers to the nature of connectivity between two or more components that enables liquids, vapors, and/or two-phase mixtures to be transported between the components in a controlled fashion (i.e., without leakage) either directly or indirectly. Coupling two or more components such that they are in fluid flow communication with each other can involve any suitable method known in the art, such as with the use of welds, flanged conduits, gaskets, and bolts. Two or more components may also be coupled together via other components of the system that may separate them, for example, valves, gates, or other devices that may selectively restrict or direct fluid flow.

The term "conduit," as used in the specification and claims, refers to one or more structures through which fluids can be transported between two or more components of a system. For example, conduits can include pipes, ducts, passageways, and combinations thereof that transport liquids, vapors, and/or gases.

The term "natural gas", as used in the specification and claims, means a hydrocarbon gas mixture consisting primarily of methane.

The terms "hydrocarbon gas" or "hydrocarbon fluid", as used in the specification and claims, means a gas/fluid comprising at least one hydrocarbon and for which hydrocarbons comprise at least 80%, and more preferably at least 90% of the overall composition of the gas/fluid.

The term "mixed refrigerant" (abbreviated as "MR"), as used in the specification and claims, means a fluid comprising at least two hydrocarbons and for which hydrocarbons comprise at least 80% of the overall composition of the refrigerant.

The terms "bundle" and "tube bundle" are used interchangeably within this application and are intended to be synonymous.

The term "ambient fluid", as used in the specification and claims, means a fluid that is provided to the system at or near ambient pressure and temperature.

The term "compression circuit" is used herein to refer to the components and conduits in fluid communication with one another and arranged in series (hereinafter "series fluid flow communication"), beginning upstream from the first compressor or compression stage and ending downstream from the last compressor or compressor stage. The term "compression sequence" is intended to refer to the steps performed by the components and conduits that comprise the associated compression circuit.

The term "suction side" is used herein to refer to the lower pressure side (or inlet) of a compression stage. Similarly, the term "discharge side" is used herein to refer to the higher pressure side (or outlet) of a compression stage. The term "outlet pressure" is intended to refer to the gauge pressure on the discharge side of a compression stage.

As used herein the "capacity" of a compression stage is intended to refer to the flow rate of fluid through that compression stage at a particular operational state. For example, in the case of a dynamic compressor stage, its capacity is intended to mean the rate at which fluid will flow through the compressor at a particular rotational speed of the driver shaft at the compressor and at a particular suction and discharge conditions.

As used herein, the term "power requirement", when used in connection with a compression stage, is intended to refer to the amount of power to operate that compression stage at a particular operational state (i.e., fluid flow rate and pressure increase).

As used in the specification and claims, the terms "high-high", "high", "medium", and "low" are intended to express relative values for a property of the elements with which these terms are used. For example, a high-high pressure stream is intended to indicate a stream having a higher pressure than the corresponding high pressure stream or medium pressure stream or low pressure stream described or claimed in this application. Similarly, a high pressure stream is intended to indicate a stream having a higher pressure than the corresponding medium pressure stream or low pressure stream described in the specification or claims, but lower than the corresponding high-high pressure stream described or claimed in this application. Similarly, a medium pressure stream is intended to indicate a stream having a higher pressure than the corresponding low pressure stream described in the specification or claims, but lower than the corresponding high pressure stream described or claimed in this application.

As used herein, the term "cryogen" or "cryogenic fluid" is intended to mean a liquid, gas, or mixed phase fluid having a temperature less than −70 degrees Celsius. Examples of cryogens include liquid nitrogen (LIN), liquefied natural gas (LNG), liquid helium, liquid carbon dioxide and pressurized, mixed phase cryogens (e.g., a mixture of LIN and gaseous nitrogen). As used herein, the term "cryogenic temperature" is intended to mean a temperature below −70 degrees Celsius.

Table 1 defines a list of acronyms employed throughout the specification and drawings as an aid to understanding the described embodiments.

TABLE 1

| | | | |
|---|---|---|---|
| SMR | Single Mixed Refrigerant | MCHE | Main Cryogenic Heat Exchanger |
| DMR | Dual Mixed Refrigerant | MR | Mixed Refrigerant |
| C3MR | Propane-precooled Mixed Refrigerant | MRL | Mixed Refrigerant Liquid |
| LNG | Liquid Natural Gas | MRV | Mixed Refrigerant Vapor |

The described embodiments provide an efficient process for the liquefaction of a hydrocarbon fluid and are particularly applicable to the liquefaction of natural gas. Referring to FIG. 1, a typical natural gas liquefaction system of the prior art is shown. A feed stream 100, which is preferably natural gas, is cleaned and dried by known methods in a pre-treatment section 90 to remove water, acid gases such as $CO_2$ and $H_2S$, and other contaminants such as mercury, resulting in a pre-treated feed stream 101. The pre-treated feed stream 101, which is essentially water free, is pre-cooled in a pre-cooling system 118 to produce a pre-cooled natural gas stream 105 and further cooled, liquefied, and/or sub-cooled in an MCHE 108 to produce LNG stream 106. The LNG stream 106 is typically let down in pressure by passing it through a valve or a turbine (not shown) and is then sent to LNG storage tank 109. Any flash vapor produced during the pressure letdown and/or boil-off in the tank is represented by stream 107, which may be used as fuel in the plant, recycled to feed, or vented.

The pre-treated feed stream 101 is pre-cooled to a temperature below 10 degrees Celsius, preferably below about 0 degrees Celsius, and more preferably about −30 degrees Celsius. The pre-cooled natural gas stream 105 is liquefied to a temperature between about −150 degrees Celsius and about −70 degrees Celsius, preferably between about −145 degrees Celsius and about −100 degrees Celsius, and subsequently sub-cooled to a temperature between about −170 degrees Celsius and about −120 degrees Celsius, preferably between about −170 degrees Celsius and about −140 degrees Celsius. MCHE 108 shown in FIG. 1 is a coil wound heat exchanger with three bundles. However, any number of bundles and any exchanger type may be utilized.

The term "essentially water free" means that any residual water in the pre-treated feed stream 101 is present at a sufficiently low concentration to prevent operational issues associated with water freeze-out in the downstream cooling and liquefaction process. In the embodiments described herein, water concentration is preferably not more than 1.0 ppm and, more preferably between 0.1 ppm and 0.5 ppm.

The pre-cooling refrigerant used in the C3MR process is propane. As illustrated in FIG. 1, propane refrigerant 110 is warmed against the pre-treated feed stream 101 to produce a warm low pressure propane stream 114. The warm low pressure propane stream 114 is compressed in one or more propane compressors 116 that may comprise four compression stages. Three side streams 111, 112, and 113 at intermediate pressure levels enter the propane compressors 116 at the suction side of the final, third, and second stages of the propane compressor 116 respectively. The compressed propane stream 115 is condensed in condenser 117 to produce a cold high pressure stream that is then let down in pressure (let down valve not shown) to produce the propane refrigerant 110 that provides the cooling duty required to cool pre-treated feed stream 101 in pre-cooling system 118. The propane liquid evaporates as it cools stream 101 to produce low pressure propane vapor stream 114. The condenser 117 typically exchanges heat against an ambient fluid such as air or water.

Although the figure shows four stages of propane compression, any number of compression stages may be employed. It should be understood that when multiple compression stages are described or claimed, such multiple compression stages could comprise a single multi-stage compressor, multiple compressors, or a combination thereof. The compressors could be in a single casing or multiple casings. The process of compressing the propane refrigerant is generally referred to herein as the propane compression sequence. The propane compression sequence is described in greater detail in U.S. patent application Ser. No. 14/870,557, published as U.S. Patent Application Pub. No. 2017/0089637 A1, the disclosure of which is incorporated by reference herein in its entirety.

In the MCHE 108, at least a portion of, and preferably all of the refrigeration is provided by vaporizing at least a portion of refrigerant streams after pressure reduction across valves or turbines.

A low pressure gaseous MR stream 130 is withdrawn from the warm end of the shell side of the MCHE 108, sent through a low-pressure suction drum 150 to prevent any entrained droplets from entering the compressor 151 and the vapor stream 131 is compressed in a low pressure (LP) compressor 151 to produce medium pressure MR stream 132. The low pressure gaseous MR stream 130 is typically withdrawn at a temperature at or near propane pre-cooling temperature and preferably about −30 degrees Celsius and at a pressure of less than 10 bara (145 psia). The medium pressure MR stream 132 is cooled in a low-pressure aftercooler 152 to produce a cooled medium pressure MR stream 133 from which any entrained droplets may be optionally removed in a medium pressure suction drum 153 to produce medium pressure vapor stream 134 that is further compressed in medium pressure (MP) compressor 154. The resulting high-pressure MR stream 135 is cooled in a medium pressure aftercooler 155 to produce a cooled high pressure MR stream 136. The cooled high-pressure MR stream 136 is optionally sent to a high-pressure suction drum 156 to remove any entrained droplets. The resulting high-pressure vapor stream 137 is further compressed in a high pressure (HP) compressor 157 to produce high-high pressure MR stream 138 that is cooled in high pressure aftercooler 158 to produce a cooled high-high pressure MR stream 139. Cooled high-high pressure MR stream 139 is then cooled against evaporating propane in pre-cooling system 118 to produce a two-phase MR stream 140. Two-phase MR stream 140 is then sent to a vapor-liquid separator 159 from which an MRL stream 141 and an MRV stream 143 are obtained, which are sent back to MCHE 108 to be further cooled. The liquid stream leaving the phase separator is referred to in the industry as MRL and the vapor stream leaving the phase separator is referred to in the industry as MRV, even after they are subsequently liquefied. The process of compressing and cooling the MR after it is withdrawn from the bottom of the MCHE 108, then returned to the tube side of the MCHE 108 as multiple streams, is generally referred to herein as the MR compression sequence.

Both the MRL stream 141 and MRV stream 143 are cooled, in two separate circuits of the MCHE 108. The MRL stream 141 is subcooled in the first two bundles of the MCHE 108, resulting in a cold stream that is let down in pressure to produce a cold two-phase stream 142 that is sent back to the shell-side of MCHE 108 to provide refrigeration required in the first two bundles of the MCHE. The MRV stream 143 is cooled, liquefied and subcooled in the first, second, and third bundles of MCHE 108, reduced in pressure across the cold high pressure letdown valve, and introduced to the MCHE 108 as stream 144 to provide refrigeration in the sub-cooling, liquefaction, and cooling steps. MCHE 108 can be any exchanger suitable for natural gas liquefaction such as a coil wound heat exchanger, plate and fin heat exchanger or a shell and tube heat exchanger. Coil wound heat exchangers are the state of art exchangers for natural gas liquefaction and include at least one tube bundle comprising a plurality of spiral wound tubes for flowing process and warm refrigerant streams and a shell space for flowing a cold refrigerant stream.

Figure 2:
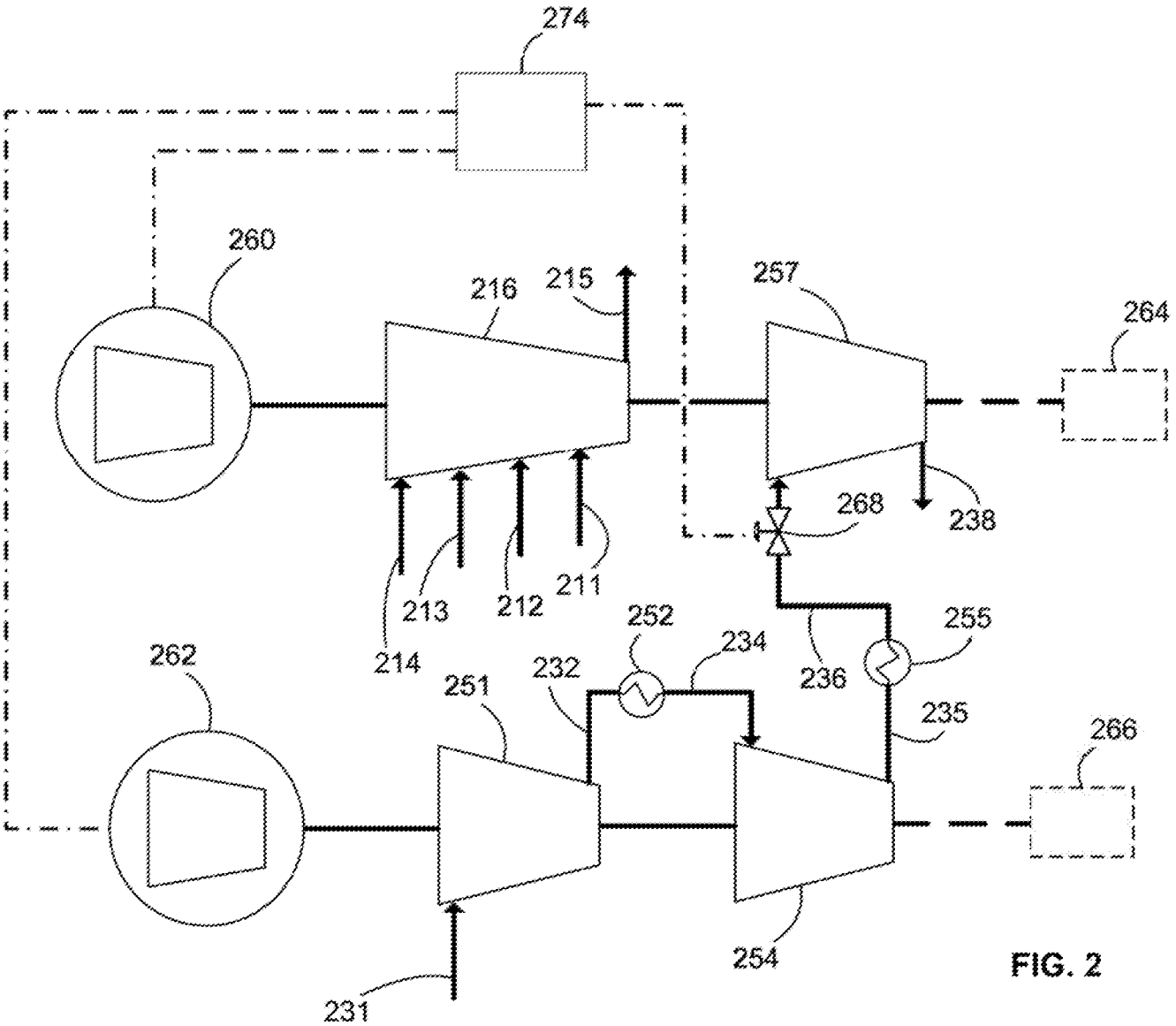
FIG. 2 is a schematic flow diagram of a split mixed refrigerant natural gas liquefication system in accordance with a first exemplary embodiment.

FIG. 2 illustrates a first exemplary embodiment. In this embodiment, elements shared with the system of FIG. 1 (System 100) are represented by reference numerals increased by factors of 100. For example, the propane compressors 116 in FIG. 1 correspond to the propane compressors 216 in FIG. 2. In the interest of clarity, some features of this embodiment that are shared with the second embodiment are numbered in FIG. 2, but are not repeated in the specification. If a reference numeral is provided in this embodiment and not discussed in the specification, it should be understood to be identical to the corresponding element of the system shown in FIG. 1. These same principles apply to each of the subsequent exemplary embodiments.

FIG. 2 illustrates a SplitMR® natural gas liquefication system 200, which includes the elements of system 100 of FIG. 1, but differs in how the compressors of the C3MR process and the MR process are driven. The system 200 includes a first gas turbine 260 that mechanically drives the propane compressor 216 and the HP MR compressor 257 (which has the highest outlet pressure of all of the MR compressors 251, 254, 257). The system 200 also includes a second gas turbine 262 that mechanically drives the LP MR compressor 251 and the MP MR compressor 254. Optionally, these compression strings could each include a helper/starter motor 264, 266, respectively.

At or near the design temperature (the ambient temperature at which the system 200 is designed to operate), the power requirements of the three MR compression stages (i.e., the LP, MP, and HP MR compressors 251, 254, and 257) and the propane compressor 216 are each set so that both gas turbines 260, 262 operate near capacity when overall production rate of the system 200 is operated near capacity.

At ambient temperatures significantly warmer than the design temperature, the power requirements for the propane compressor 216 increase, while the power available from the first gas turbine 260 deceases. In such circumstances, the discharge pressure of the propane compressor 216 must increase so that the propane therein can condense in the condenser. This increase in head (i.e., the work or energy in foot-pounds required to polytropically compress and transfer one pound of a given gas from one pressure level to another) requires the propane compressor 216 to use a larger portion of the power available from the first gas turbine 260 as compared to the design conditions. However, without any means of independently changing the characteristics of the HP MR compressor 257, there is a limited amount of power that can be shifted to the propane compressor 216 through ordinary controls, such as changing the speed of the first gas turbine 260 or opening of the MR JT valves. Consequently, the propane flow from the propane compressor 216 becomes the bottleneck for production at these warmer ambient temperatures because the first gas turbine 260 is being operated at maximum available power. Although there is power available on the second gas turbine 262 driving the LP and MP MR compressors 251, 254 (i.e., it is not operating at maximum available power), such power cannot be used because any increase in MR circulating flow would require an increase in propane flow to precool this additional MR refrigerant and increase the power requirement for the HP MR compressor 257. As used in this application, "maximum available power" is intended to refer to maximum utilization of the fuel and air supply available to a driver under the current operating conditions. As noted above, maximum available power to a driver decreases as ambient temperature rises.

To increase power efficiency at such ambient temperatures, the split MR liquefication system 200 is configured to adjust the characteristics of the HP MR compressor 257 to require less power in warmer ambient temperatures and more power in colder ambient temperatures compared to the design temperature. Such adjustments allow for shifting the balance of power between the propane compressor 216 and the HP MR compressor 257.

There are numerous means that could be provided to enable adjustment of the power requirement for a compressor. For example, the SplitMR® liquefication system 200 incorporates a suction throttle valve 268 connected between the HP MR compressor 257 and the cooled HP MR stream 236 received from the MP aftercooler 255 connected to the MP MR compressor 254. The opening of a suction throttle valve 268 can be adjusted to change the density of the fluid and suction pressure of the fluid entering the HP MR compressor 257, thereby changing the amount of power the HP MR compressor 257 needs to perform efficiently.

When ambient temperature is higher than the design temperature for the MR liquefaction system 200, the suction throttle valve 257 is adjusted to a more closed position. This adjustment allows more power from the first gas turbine 260 to be devoted to the propane compressor 216, allowing for a greater circulation of propane flow. Increasing propane flow also allows for an increase in overall MR flow, resulting in a more efficient use of power from both the first and second gas turbines 260, 262. Overall, by regulating the density of cooled HP MR fluid via the suction throttle valve 268, more total available power from both the first and second gas turbines 260, 262 can be used to circulate more refrigerant, resulting in higher, more efficient LNG production.

Conversely, at ambient temperatures colder than design, the power requirements for the propane compressor 216 decrease, while the power available from the first gas turbine 260 increases. To provide more power to the HP MR compressor 257 relative to the propane compressor 216, which is on the same driver shaft, the suction throttle valve 268 can be adjusted to a more open position. This has the benefit of shifting more power to the HP MR compressor 257, allowing the C3MR process to which the split MR liquefication system 200 is connected to increase LNG production at ambient temperatures colder than design.

Another way of expressing these concepts is that when ambient temperatures are outside of the design range, the "power requirement differential" between the drivers 260, 262 is larger than at the design ambient conditions. This typically means that one of the drivers 260, 262 is operating at a "power ratio" that is close to 1.0 but the other driver is not. For purposes of this application, the term "power ratio" means the ratio of the power being delivered by the driver over the maximum available power to that driver. The term "power differential" is the difference between power ratio of the first driver and the power ratio of the second driver.

In this exemplary embodiment, the position of the suction throttle valve 268 and the power state of the turbines 260, 262 are monitored and controlled by a controller 274.

Preferably, the controller 274 includes the capability to measure (or otherwise determine) the ambient temperature and available power on the gas turbine drivers and is programmed to automatically adjust the position of the suction throttle valve 268 and the power state of the turbines 260, 262 based on ambient temperature. The controller 274 is not shown in FIG. 3 or 7 but could be used in connection with either of the exemplary embodiments depicted therein.

Figure 3:
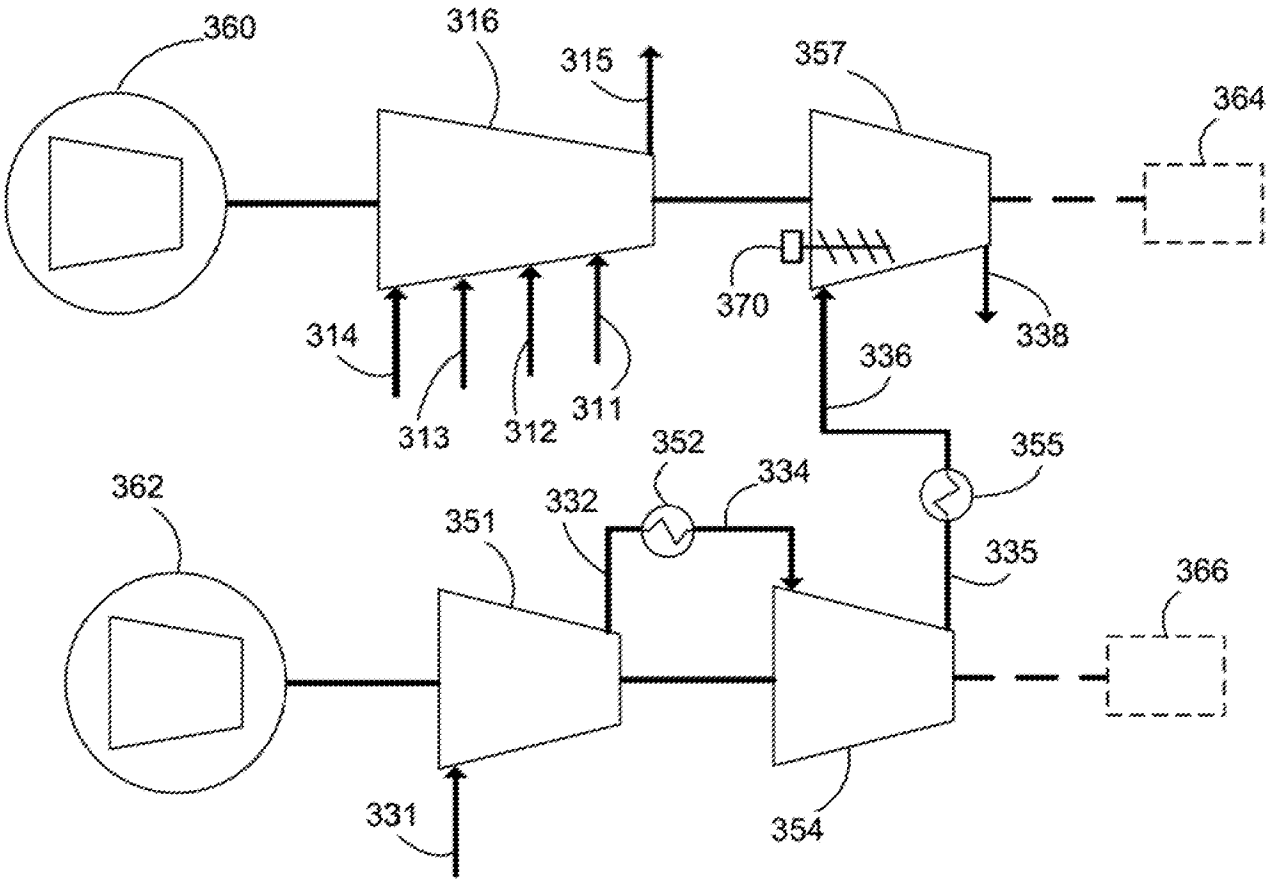
FIG. 3 is a schematic flow diagram of a split mixed refrigerant natural gas liquefication system in accordance with a second exemplary embodiment.
Figure 4B:
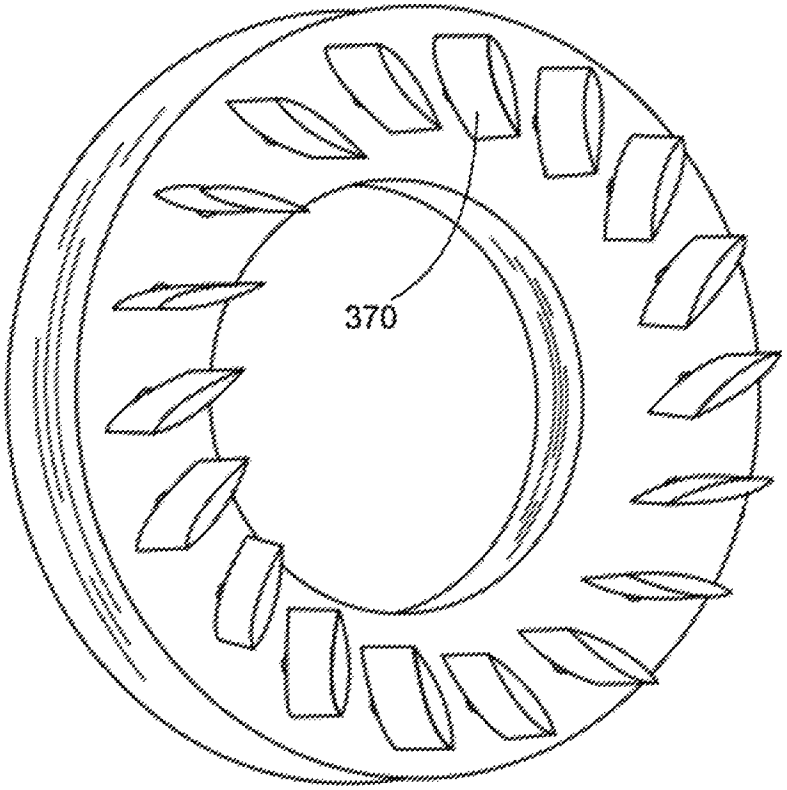
FIG. 4B is a perspective view of the adjustable inlet guide vane of FIG. 4A, with the adjustable inlet guide vane configured in a more flow-restrictive position (i.e. more closed)
Figure 4A:
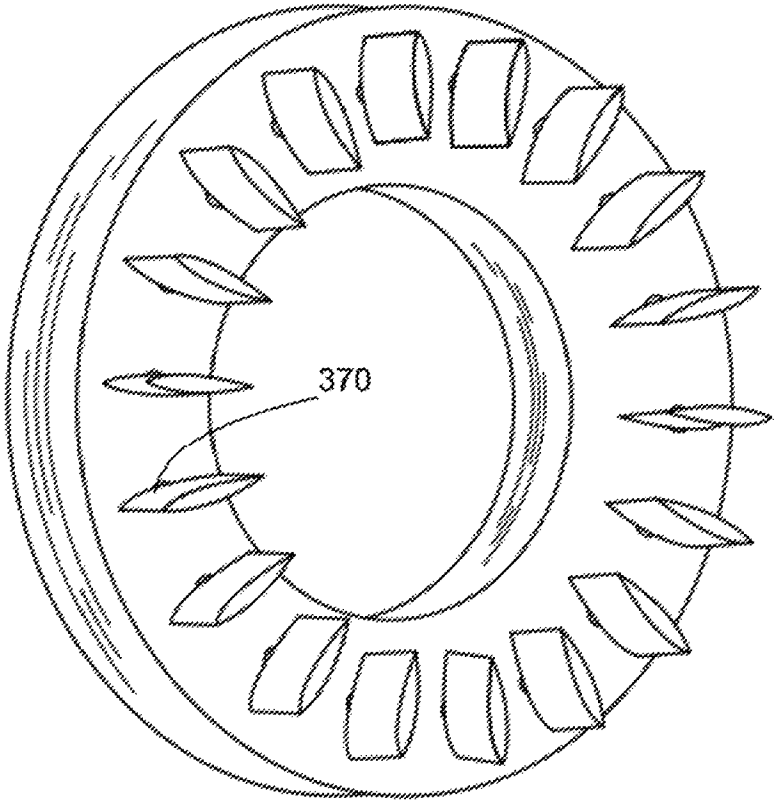
FIG. 4A is a perspective view of an adjustable inlet guide vane to be used in connection with the split mixed refrigerant natural gas liquefication system shown in FIG. 3, the adjustable inlet guide vane being configured in a less flow-restricting position (i.e. more open)

Turning now to FIGS. 3 and 4A-B, a second embodiment of a split MR liquefication system 300 that incorporates a different method for independently changing the characteristics of the HP MR compressor 357 is shown. More particularly, the split MR liquefication system 300 includes a set of adjustable inlet guide vanes 370 on the inlet of the HP MR compressor 357 that receives the cooled HP MR stream 336. At temperatures warmer than design, the inlet guide vanes 370 can be adjusted to impart less dynamic head per volumetric flow by the HP MR compressor 357, as illustrated in FIG. 4B, such that HP MR compressor 357 imparts less dynamic head per inlet volumetric flow from the cooled HP MR stream 336, thus lowering the power requirement for the HP MR compressor 357 and increasing the power available for the propane compressor 316. At ambient temperatures colder than design, the inlet guide vanes 370 on the HP MR compressor 357 can be opened, as illustrated in FIG. 4A, to impart more dynamic head per volumetric flow and increase the power consumption of the HP MR compressor 357. The inlet guide vanes 370 shown in FIG. 3 can be beneficial over the suction throttle valve 268 shown in FIG. 2 in that the inlet guide vanes 370 avoid the losses associated with throttling the suction of the HP MR compressor 257.

In another exemplary embodiment, adjustable diffuser vanes could be used to adjust the power requirement of the HP MR compressor 357 instead of adjustable inlet guide vanes 370. Instead of being located at the inlet (suction side) of a compression stage, diffuser vanes are located on the outlet side. This method will change the dynamic head and flow characteristics of the compressor in a way that is different than the inlet guide vanes.

Figure 5:
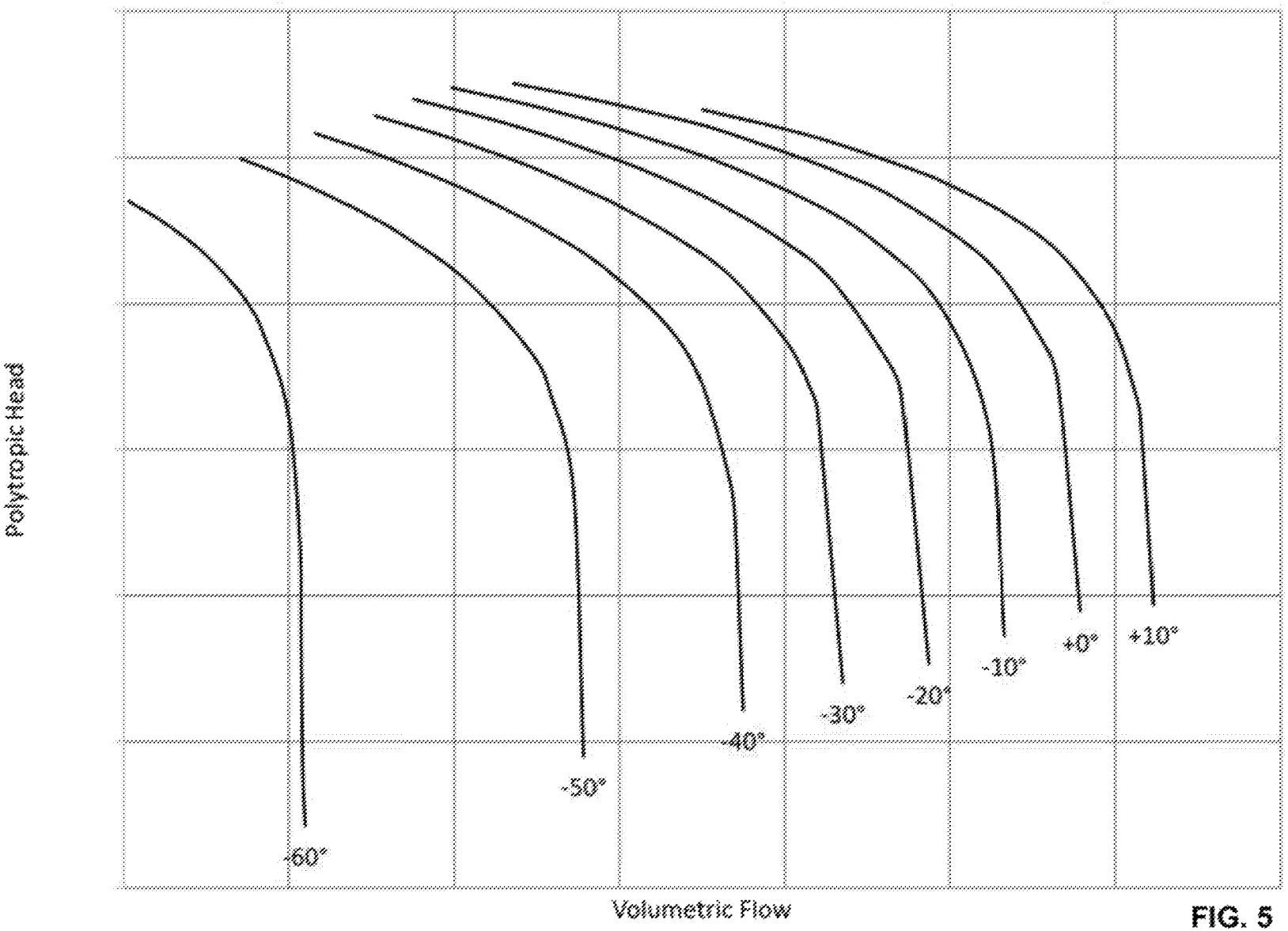
FIG. 5 is an exemplary head/flow chart for a compressor stage with inlet guide vanes.

FIG. 5 shows an exemplary head/flow chart for a compressor stage. As the inlet guide vanes are opened, the capacity of the compressor increases and delivers more head per volumetric flow, which in turn will absorb more power from the driver. Conversely, closing the inlet guide vanes reduces the capacity of the compressor and delivers less head per volumetric flow, which in turn will absorb less power from the driver.

Figure 6:
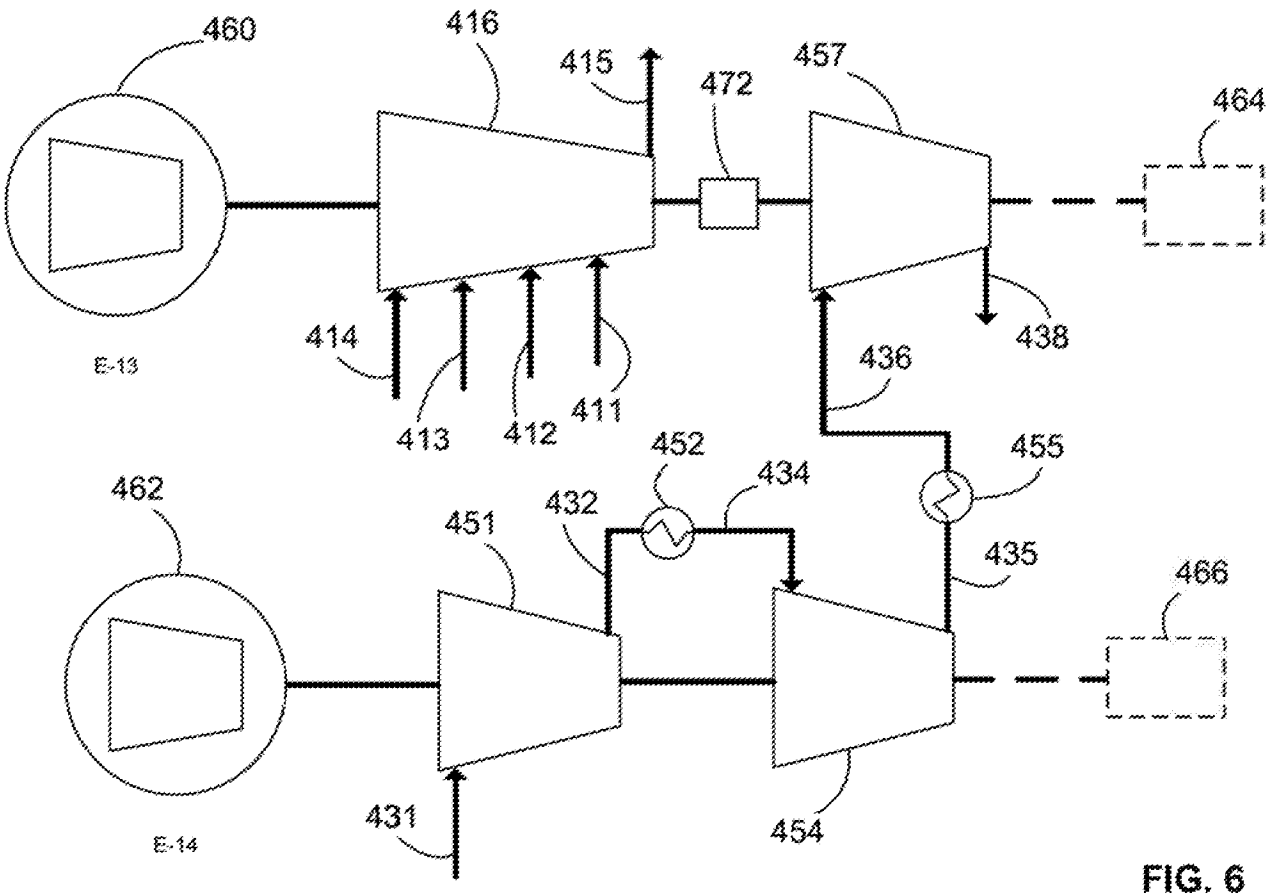
FIG. 6 is a schematic flow diagram of a split mixed refrigerant natural gas liquefication system in accordance with a third exemplary embodiment.

FIG. 6 illustrates a third embodiment of a split MR liquefication system that is configured to change the characteristics of the HP MR compressor 457 to shift power to/from the propane compressor 416. In this embodiment, the split MR liquefication system modulates the speed of the HP MR compressor 457 using a variable speed gearbox 472 installed between the propane compressor 416 and the HP MR compressor 457. The variable speed gearbox 472 enables the HP MR compressor 457 to operate at an optimal speed that may be higher or lower than the optimal speed of the propane compressor 416. Further, the variable speed gearbox 472 is configured to make adjustments to the speed of operation for the HP MR compressor in accordance with changes to the ambient temperature of the split MR liquefication system 400.

Many additional modifications to the split MR liquefications systems 200, 300, and 400 can be made without departing from the intended spirit of the present invention. For example, in one embodiment, the gas turbines (i.e., first and second gas turbines 260 and 262, 360 and 362, and 460 and 462) may be substituted for steam turbines, aero-derivative turbines, or electric motors. All other such modifications are intended to be considered within the scope of the present invention. It is intended that the present invention only be limited by the terms of the appended claims.

The invention claimed is:

1. A method of operating a hydrocarbon fluid liquefaction system, the method comprising:

a. precooling a hydrocarbon feed stream by indirect heat exchange with a precooling refrigerant stream to produce a precooled hydrocarbon fluid stream having a temperature within a first predetermined range;

b. compressing the precooling refrigerant stream in a precooling compressor having at least one compression stage;

c. further cooling and at least partially liquefying the precooled hydrocarbon stream by indirect heat exchange against a second refrigerant stream to produce a cooled hydrocarbon fluid stream having a temperature within a second predetermined range;

d. compressing the second refrigerant stream in a compression sequence comprising a plurality of second refrigerant compression stages;

e. driving the precooling compressor and at least one second refrigerant compression stage of the plurality of second refrigerant compression stages with a first driver having a maximum available power;

f. driving the remaining second refrigerant compression stages of the plurality of second refrigerant compression stages with a second driver having a second maximum available power, wherein the maximum available power to each of the first and second drivers represents maximum utilization of fuel available to the first driver while step (e) is being performed and maximum utilization of fuel available to the second driver while step (f) is being performed; and g. operating the at least one second refrigerant compression stage at a first power requirement, which results in a first combined power utilized by the first and second drivers, wherein one of the first driver and the second driver is operated at the maximum available power when the at least one second refrigerant compression stage is operated at the first power requirement;

h. adjusting the at least one second refrigerant compression stage to operate the at least one second refrigerant compression stage at a second power requirement, wherein operating the at least one second refrigerant compression stage at the second power requirement enables one of the first and second drivers to operate closer to the maximum available power than when the at least one second refrigerant compression stage is operated at the first power requirement and results in increased production of the cooled hydrocarbon fluid stream in step (c);

i. after performing step (h), operating the first and second drivers at a -second combined power that is greater than the first combined power.

2. The method of claim 1, wherein step (e) comprises driving the precooling compressor and at least one second refrigerant compression stage of the plurality of second refrigerant compression stages with the first driver having the maximum available power, the at least one second refrigerant compression stage having a discharge pressure that is greater than any other compression stage of the plurality of second refrigerant compression stages.

3. The method of claim 1, further comprising performing step (h) wherein an ambient temperature is outside a predetermined design ambient temperature.

4. The method of claim 1, further comprising performing step (h) wherein an ambient temperature is above a predetermined design ambient temperature.

5. The method of claim 4, wherein step (h) comprises decreasing the power requirement of the at least one second refrigerant compression stage.

6. The method of claim 1, wherein step (g) comprises operating at least one second refrigerant compression stage at a first power requirement, which results in a first combined power utilized by the first and second drivers, one of the first and second drivers delivering maximum available power and another one of the first and second drivers not delivering maximum available power as result of compression demands of the at least one second refrigerant compression stage and the precooling compressor.

7. The method of claim 1, wherein adjusting the power requirement of the at least one second refrigerant compression stage to a second power requirement comprises adjusting the position of a suction throttle valve in fluid flow communication with a suction side of the at least one second refrigerant compression stage.

8. The method of claim 7, wherein adjusting the power requirement of the at least one second refrigerant compression stage to a second power requirement comprises changing the position of a set of adjustable inlet guide vanes located in the at least one second refrigerant compression stage.

9. The method of claim 1, wherein adjusting the power requirement of the at least one second refrigerant compression stage to a second power requirement comprises changing a gear ratio of a variable speed gearbox located between the precooling compressor and the at least one second refrigerant compression stage on a drive shaft of the first driver.

10. The method of claim 1, wherein the second refrigerant comprises a mixed refrigerant.

11. The method of claim 1, wherein the precooling refrigerant consists of propane.

12. The method of claim 1, wherein the precooling refrigerant stream consists of a mixed refrigerant.

13. A system comprising:

a precooling subsystem having a precooling compressor having at least one first refrigerant compression stage and at least one precooling heat exchanger, the precooling subsystem being adapted to cool a hydrocarbon feed stream by indirect heat exchange against a first refrigerant stream to produce a precooled hydrocarbon fluid stream;

a liquefaction subsystem having a plurality of second refrigerant compression stages and at least one liquefaction heat exchanger, the liquefaction system being adapted to at least partially liquefy the precooled hydrocarbon stream by indirect heat exchange against a second refrigerant stream to produce a cooled hydrocarbon fluid stream;

a first driver that drives the precooling compressor and at least one second refrigerant compression stage of the plurality of second refrigerant compression stages;

a second driver that drives the remaining second refrigerant compression stages of the plurality of second refrigerant compression stages;

means for changing a power requirement of the at least one second refrigerant compression stage; and a controller adapted to measure a first power state of the first driver and a second power state of the second driver and to control the power requirement of the at least one second refrigerant compression stage, the first power state of the first driver, the second power state of the second driver, and a flow rate of at least one selected from the group of the hydrocarbon feed stream and the precooled hydrocarbon stream;

wherein when one of the first power state and the second power state is less than the maximum available power, the controller is adapted to adjust the means for changing the power requirement of the at least one second refrigerant compression stage, wherein the adjustment of the means for changing the power requirement of the at least one second refrigerant compression stage results in a reduction in a difference between the first power state and the second power state, an increase in a sum of the first power state and the second power state, and an increase in production of the precooled hydrocarbon fluid stream.

14. The system of claim 13, wherein the at least one second refrigerant compression stage has a discharge pressure that is greater than any other second refrigerant compression stages of the plurality of second refrigerant compression stages.

15. The system of claim 13, wherein the means for changing a power requirement of the at least one second refrigerant compression stage comprises a suction throttle valve in fluid flow communication with a suction side of the at least one second refrigerant compression stage.

16. The system of claim 13, wherein means for changing a power requirement of the at least one second refrigerant compression stage comprises a set of adjustable guide vanes in fluid flow communication with a suction side of the at least one second refrigerant compression stage.

17. The system of claim 13, wherein means for changing a power requirement of the at least one second refrigerant compression stage comprises a variable speed gearbox located between the precooling compressor and the at least one second refrigerant compression stage on a drive shaft of the first driver.

18. The system of claim 13, wherein in the first driver comprises at least two drivers arranged in parallel.

19. The system of claim 13, wherein the second driver comprises at least two drivers arranged in parallel.

20. The method of claim 13, wherein the second refrigerant stream comprises a mixed refrigerant.

21. The method of claim 13, wherein the first refrigerant stream consists of propane.

22. The method of claim 13, wherein the precooling refrigerant stream consists of a mixed refrigerant.

23. A method of operating a hydrocarbon fluid liquefaction system, the method comprising:

a. precooling a hydrocarbon feed stream, being fed at a first flow rate, by indirect heat exchange with a precooling refrigerant stream and a precooled hydrocarbon fluid stream having a temperature within a first predetermined range;

b. compressing the precooling refrigerant stream in a precooling compressor having at least one compression stage;

c. further cooling and at least partially liquefying the precooled hydrocarbon stream by indirect heat exchange against a second refrigerant stream to produce a cooled hydrocarbon fluid stream having a temperature within a second predetermined range;

d. compressing the second refrigerant stream in a compression sequence comprising a plurality of second refrigerant compression stages, the plurality of second refrigerant compression stages consisting of a first set of second refrigerant compression stages and a second set of second refrigerant compression stages;

e. driving the precooling compressor and the first set of second refrigerant compression stages with a first driver;

f. driving the second set of second refrigerant compression stages with a second driver;

g. operating at least one of the first set of second refrigerant compression stages at a first power requirement that results in a first power differential between the first driver and second driver;

h. adjusting the compression power requirement of at least one of the first set of second refrigerant compression stages, which results in a second power differential between the first driver and the second driver, the second power differential being less than the first power differential; and i. increasing the first flow rate of the hydrocarbon feed stream to a second flow rate either concurrently or after performing step (h), while maintaining the temperature of the precooled hydrocarbon fluid stream within the first predetermined range and the temperature of the cooled hydrocarbon fluid stream within the second predetermined range.

24. The method of claim 23, wherein step (e) comprises driving the precooling compressor and the first set of second refrigerant compression stages with a first driver, the first set of second refrigerant compression stages consisting of a stage having a discharge pressure that is greater than any of the second set of second refrigerant compression stages.

25. The method of claim 23, further comprising performing step (h) wherein an ambient temperature is outside a predetermined design ambient temperature.

26. The method of claim 23, further comprising performing step (h) wherein an ambient temperature is above a predetermined design ambient temperature.

27. The method of claim 26, wherein step (h) comprises decreasing the power requirement of the at least one of the first set of second refrigerant compression stages.

28. The method of claim 23, wherein adjusting the compression power requirement of at least one of the first set of second refrigerant compression stages comprises adjusting the position of a suction throttle valve in fluid flow communication with a suction side of the at least one of the first set of second refrigerant compression stages.

29. The method of claim 23, wherein adjusting the compression power requirement of at least one of the first set of second refrigerant compression stages comprises changing the position of a set of adjustable inlet guide vanes located in the at least one of the first set of second refrigerant compression stages.

30. The method of claim 23, wherein adjusting the compression power requirement of at least one of the first set of second refrigerant compression stages comprises changing a gear ratio of a variable speed gearbox located between the precooling compressor and the at least one of the first set of second refrigerant compression stages on a drive shaft of the first driver.

31. The method of claim 23, wherein the second refrigerant stream comprises a mixed refrigerant.

32. The method of claim 23, wherein the precooling refrigerant stream consists of propane.

33. The method of claim 23, wherein the precooling refrigerant stream consists of a mixed refrigerant.

* * * * *